US009489895B2

(12) United States Patent
Kim et al.

(10) Patent No.: US 9,489,895 B2
(45) Date of Patent: Nov. 8, 2016

(54) ORGANIC LIGHT-EMITTING DISPLAY DEVICE WITH SIGNAL LINES FOR CARRYING BOTH DATA SIGNAL AND SENSING SIGNAL

(71) Applicant: LG Display Co., Ltd., Seoul (KR)

(72) Inventors: Seung Tae Kim, Goyang-si (KR); Bum Sik Kim, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/134,346

(22) Filed: Apr. 20, 2016

(65) Prior Publication Data

US 2016/0232850 A1 Aug. 11, 2016

Related U.S. Application Data

(62) Division of application No. 13/708,714, filed on Dec. 7, 2012, now Pat. No. 9,349,316.

(30) Foreign Application Priority Data

Dec. 12, 2011 (KR) ..... 10-2011-0133273

(51) Int. Cl.
*G09G 3/3258* (2016.01)
*G09G 3/32* (2016.01)

(52) U.S. Cl.
CPC ..... *G09G 3/3258* (2013.01); *G09G 3/3233* (2013.01); *G09G 2310/0272* (2013.01); *G09G 2330/028* (2013.01)

(58) Field of Classification Search
CPC ..... G09G 3/3258; G09G 3/3233; G09G 200/0465; G09G 2310/0272; G09G 2330/028
See application file for complete search history.

(56) References Cited

U.S. PATENT DOCUMENTS 7,859,501 B2 12/2010 Levey et al.
7,889,160 B2 2/2011 Yoo
(Continued)

FOREIGN PATENT DOCUMENTS

CN 101373578 A 2/2009
CN 102163402 A 8/2011
(Continued)

OTHER PUBLICATIONS

State Intellectual Property Office of the People's Republic of China, Office Action, Chinese Patent Application No. 201210535061.9, May 7, 2015, seven pages [with concise explanation of relevance in English].
(Continued)

*Primary Examiner* — Kumar Patel
*Assistant Examiner* — Sejoon Ahn
(74) *Attorney, Agent, or Firm* — Fenwick & West LLP

(57) ABSTRACT

An organic light-emitting display device having a signal line that is shared by a first column of pixels and a second column of pixels to transmit a data signal and a sensing signal. The organic light-emitting display device includes a plurality of columns of pixels, and a plurality of signal lines extending between the plurality of columns of pixels. Each of the plurality of signal lines is configured to transmit a data signal from a data driver to the first column of pixels at first times. The data signals control the operation of an organic light-emitting element in the first column of pixels. The same signal line transmits a sensing signal from the second column of pixels to the data driver at second times. The sensing signal represents a variable property of an electrical component in a pixel of the second column of pixels.

8 Claims, 8 Drawing Sheets

(56) References Cited

U.S. PATENT DOCUMENTS

| | | | | |
|---|---|---|---|---|
| 8,115,707 | B2 | 2/2012 | Nathan et al. | |
| 8,654,063 | B2 | 2/2014 | Kim et al. | |
| 8,736,781 | B2 | 5/2014 | Lee | |
| 2005/0156856 | A1 | 7/2005 | Jang et al. | |
| 2005/0264496 | A1 | 12/2005 | Shim | |
| 2006/0001620 | A1 | 1/2006 | Choi | |
| 2006/0061535 | A1 | 3/2006 | Kim et al. | |
| 2006/0077137 | A1 | 4/2006 | Kwon | |
| 2006/0227094 | A1 | 10/2006 | Park et al. | |
| 2006/0256048 | A1 | 11/2006 | Fish et al. | |
| 2006/0267885 | A1 | 11/2006 | Kwak et al. | |
| 2007/0001938 | A1 | 1/2007 | Lee et al. | |
| 2007/0030230 | A1 | 2/2007 | Lee | |
| 2008/0001545 | A1 | 1/2008 | Uchino et al. | |
| 2008/0030443 | A1 | 2/2008 | Yamashita et al. | |
| 2008/0074363 | A1 | 3/2008 | Yamashita et al. | |
| 2008/0122381 | A1 | 5/2008 | Jung | |
| 2008/0297449 | A1 | 12/2008 | Yamashita et al. | |
| 2009/0051628 | A1 | 2/2009 | Kwon | |
| 2009/0184896 | A1 | 7/2009 | Kwon | |
| 2009/0284451 | A1 | 11/2009 | Yamamoto et al. | |
| 2010/0109540 | A1 | 5/2010 | Kim et al. | |
| 2010/0117938 | A1 | 5/2010 | Tanikame | |
| 2011/0007067 | A1* | 1/2011 | Ryu | G09G 3/3233 345/214 |
| 2011/0084955 | A1 | 4/2011 | Kim | |
| 2011/0122119 | A1 | 5/2011 | Bae et al. | |
| 2011/0157134 | A1 | 6/2011 | Ogura | |
| 2011/0205250 | A1 | 8/2011 | Yoo et al. | |
| 2011/0221791 | A1* | 9/2011 | Kajiyama | G09G 3/3233 345/690 |
| 2011/0227505 | A1* | 9/2011 | Park | H05B 33/0896 315/297 |
| 2012/0127220 | A1 | 5/2012 | Noguchi | |
| 2013/0169702 | A1 | 7/2013 | Ono | |
| 2015/0145845 | A1 | 5/2015 | Nam et al. | |
| 2015/0187276 | A1 | 7/2015 | Shim et al. | |

FOREIGN PATENT DOCUMENTS

| | | | |
|---|---|---|---|
| CN | 102222463 | A | 10/2011 |
| DE | 10 2010 061 736 | A1 | 6/2011 |
| KR | 10-2009-0073464 | A | 7/2009 |
| KR | 10-2009-0080270 | A | 7/2009 |
| KR | 10-2011-0063045 | A | 6/2011 |
| KR | 10-2011-0108033 | A | 10/2011 |
| WO | WO 2009/002406 | A1 | 12/2008 |

OTHER PUBLICATIONS

Chinese First Office Action, Chinese Application No. 201210535061.9, Sep. 3, 2014, 15 pages.

English translation of German Office Action, German Patent Application No. DE 10 2012 112 130.3,.Dec. 22, 2014, seven pages.

Taiwan Intellectual Property Office, Notice of Allowance, Taiwanese Patent Application No. 101146966, Jan. 11, 2015, thirteen pages [with concise explanation of relevance in English].

United States Office Action, U.S. Appl. No. 13/708,714, Aug. 10, 2015, 12 pages.

United States Office Action, U.S. Appl. No. 13/708,714, Dec. 29, 2014, 14 pages.

* cited by examiner

ORGANIC LIGHT-EMITTING DISPLAY DEVICE WITH SIGNAL LINES FOR CARRYING BOTH DATA SIGNAL AND SENSING SIGNAL

CROSS-REFERENCE TO RELATED APPLICATIONS

The present application is a divisional application of U.S. patent application Ser. No. 13/708,714 filed on Dec. 7, 2012, which claims priority under 35 U.S.C. §119(a) to Korean Patent Application No. 10-2011-0133273 filed on Dec. 12, 2011, which is hereby incorporated by reference in its entirety.

BACKGROUND

1. Field of the Disclosure

The present application relates to an organic light-emitting display (OLED) device.

2. Description of the Related Art

Flat display devices for displaying information are being widely developed. The display devices include liquid crystal display devices, organic light-emitting display devices, electrophoresis display devices, field emission display devices, and plasma display devices. Among these display devices, organic light-emitting display devices have the features of lower power consumption, wider viewing angle, lighter weight and higher brightness compared to liquid crystal display devices. As such, the organic light-emitting display (OLED) device is considered to be a next generation display device.

Thin film transistors used in the organic light-emitting display device can be driven in high speed. To this end, the thin film transistors increase carrier mobility using a semiconductor layer which is formed from polysilicon. Polysilicon can be derived from amorphous silicon through a crystallizing process. A laser scanning mode is widely used in the crystallizing process. During such a crystallizing process, the power of a laser beam can be unstable. As such, the thin film transistors formed on the scanned line, which is scanned by the laser beam, can have different threshold voltages from each other. This can cause image quality to be non-uniform between pixels.

To address this matter, a technology detecting the threshold voltages of pixels and compensating for the threshold voltages of thin film transistors had been proposed. However, in order to realize such threshold voltage compensation, transistors and signal lines connected between the transistors must be added into the pixel. Addition of such transistors and signal lines increases the circuit configuration of the pixel. Moreover, the added transistor and signal lines can reduce an aperture ratio of the pixel, which causes shortening of the life span of the OLED device.

BRIEF SUMMARY

Embodiments relate to an organic light-emitting display device having a signal line that is shared by a first column of pixels and a second column of pixels to transmit a data signal and a sensing signal. The organic light-emitting display device includes a plurality of columns of pixels, and a plurality of signal lines extending between the plurality of columns of pixels. Each of the plurality of signal lines is configured to transmit a data signal from a data driver to the first column of pixels at first times. The data signals control the operation of an organic light-emitting element in the first column of pixels. The same signal line transmits a sensing signal from the second column of pixels to the data driver at second times. The second column of pixels is adjacent to the first column of pixels. The sensing signal represents a variable property of an electrical component in a pixel of the second column of pixels.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
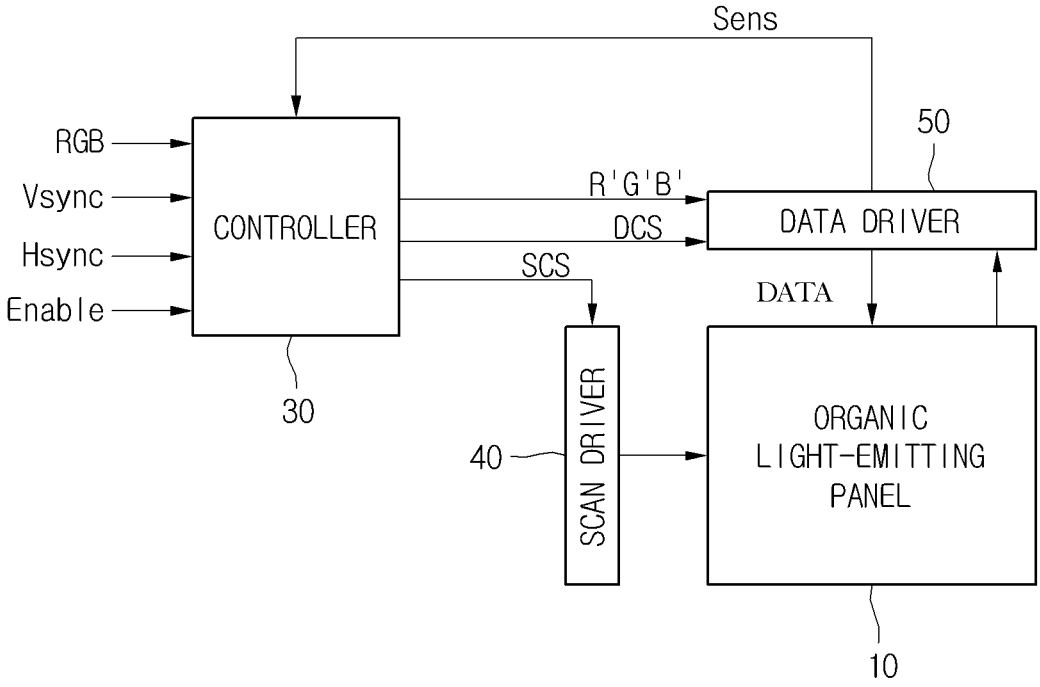
FIG. 1 is a block diagram showing an organic light-emitting display device according to an embodiment of the present disclosure.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 1 is a block diagram showing an organic light-emitting display (OLED) device according to one embodiment. The organic light emitting display device of FIG. 1 may include, among other components, an organic light emitting panel 10, a controller 30, a scan driver 40 and a data driver 50. The scan driver 40 is a circuit that generates and sends first through third scan signals SCAN1 through SCAN3 to the organic light-emitting panel 10, as described below in detail with reference to FIGS. 4A, 5A and 6A.

The data driver 50 is a circuit that applies data voltage signals to the organic light-emitting panel 10. Also, the data driver 50 can receive sensing signals Sens from the organic light emitting panel 10 during a sensing period and transmit the sensing signals Sens to the controller 30.

The controller 30 is hardware, firmware, software or a combination thereof that generates scan control signals SCS and data control signals DCS from enable signal Enable, vertical synchronous signal Vsync and horizontal synchronous signal. The scan control signals SCS controls the scan driver 40, and the data control signals DCS controls the data driver 50. The controller 30 can modify received data signals RGB based on the sensing signals Sens from the data driver 50 to generate compensated data signals R'G'B' supplied to the data driver 50. The compensated data signals R'G'B' can be converted into compensated analog data voltage signals DATA by the data driver 50. The compensated analog data voltage signals DATA can be applied from the data driver 50 to the organic light emitting panel 10.

The compensated analog data voltage signals DATA can operate organic light emission elements on the organic light emitting panel 10. The compensated analog data voltage signals DATA are adjusted to compensate for the threshold voltage of each drive transistor and the properties of each organic light emission element.

Among other advantages, the organic light emitting display device of the present embodiment enables the use of a sensing signal Sens to indicate the threshold voltage of the drive transistor and the properties of the organic light emission element in the organic light emitting panel 10, and also enables the controller 30 to generate a compensated data signal R'G'B' based on the sensing signal Sens. As such, the threshold voltage and the drive transistor and the properties of the organic light emission element can be compensated to prevent non-uniformity of brightness in the organic light emitting panel 10.

Figure 2:
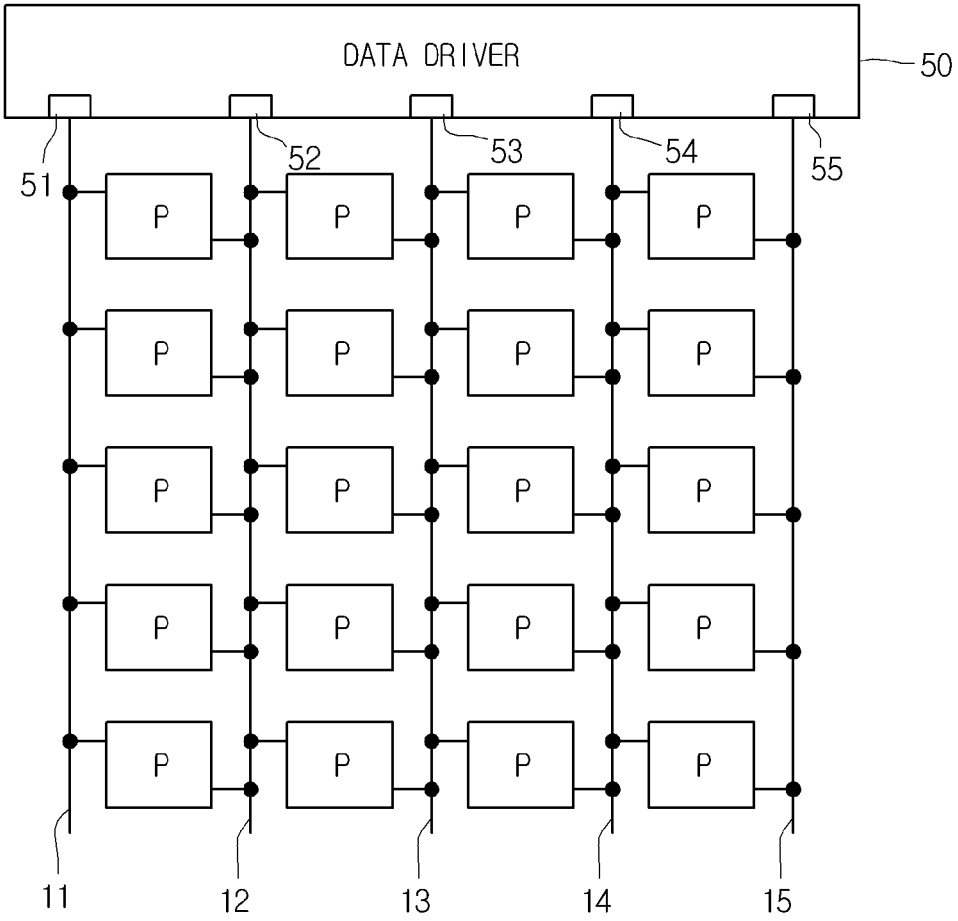
FIG. 2 is a plan view showing an organic light-emitting panel according to one embodiment.

FIG. 2 is a plan view showing an organic light-emitting panel according to one embodiment. The organic light emitting panel 10 according to the first embodiment includes a plurality of data lines 11 through 15 connected to the data driver 50. The data lines 11 through 15 are connected to respective channels 51 through 55 of the data driver 50. The channels 51 through 55 are terminals for applying the data voltage signals DATA to the organic light emitting panel 10 and for receiving the sensing signals Sens from the organic light emitting panel 10. In the example of FIG. 2, the data lines 11 through 15 extend vertically. Pixels P are arranged between the data lines 11 through 15.

Although not shown in FIG. 2, first through third scan lines extend horizontally in a direction perpendicular to the direction that the data lines 11 through 15 extend. The first through third scan lines are used to transfer first through third scan signals SCAN 1, SCAN 2 and SCAN 3.

Each of the pixels P can be electrically connected to two of the data lines 11 through 15 adjacent to the pixels P. For example, all the pixels P between the second and third data lines 12 and 13 are connected to the second and third data lines 12 and 13.

The data lines 11 through 15 can be electrically connected to the pixels adjacent to each other. For example, the second data line 12 can be connected to the pixels on the left side of the second data line 12 and the pixels on the right side of the second data line 12. In other words, each data line 11 through 15 can be shared with the adjacent pixels P.

The data voltage signals DATA generated by the data driver 50 are transmitted via the data lines 11 through 15 to the pixels P positioned at the right side of the data lines 11 through 15. Also, the sensing signals Sens sensed in the pixels positioned at the left side of the data lines 11 through 15 can be transmitted through the data lines 11 through 15.

In the present embodiment, data lines 11 through 15 are used for supplying the data voltages DATA but also for transmitting the sensing signals Sens. Since the need for separate signal lines for transmitting the sensing signals Sens can be obviated, the number of channels 51 through 55 of the data driver 50 can be reduced.

In the embodiment of FIG. 2, the number of data lines 11 through 15 is one more than the number of pixel columns. For example, in the organic light emitting panel 10 of FIG. 2, there are five data lines 11 through 15, but there are only four the pixel columns.

Figure 3:
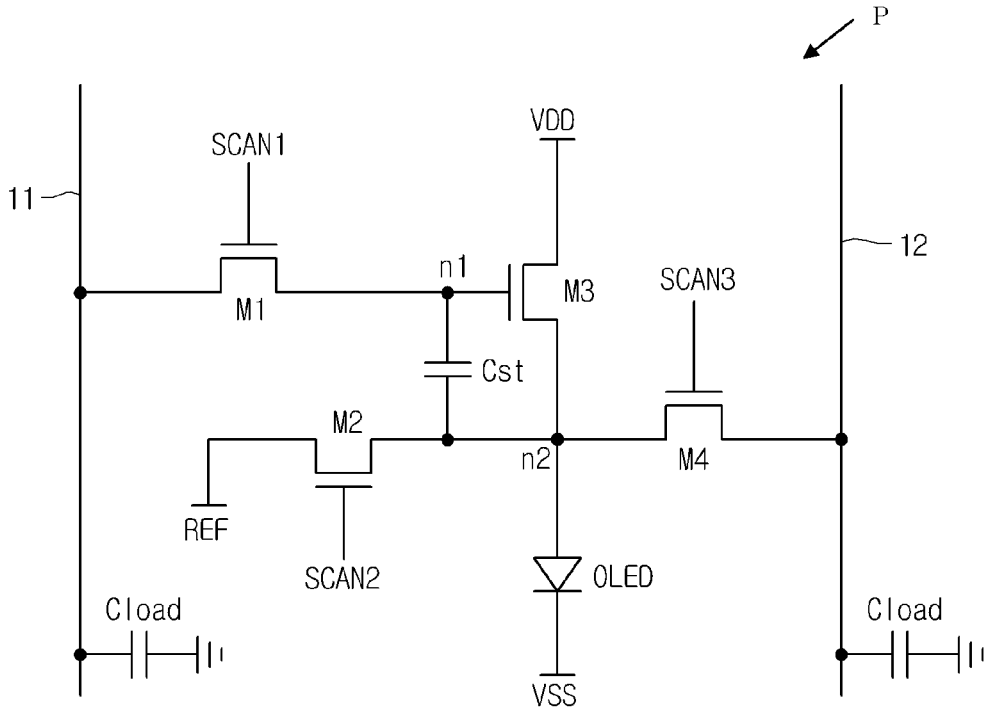
FIG. 3 is a circuit diagram showing the circuit of a pixel in FIG. 2, according to one embodiment.

FIG. 3 is a circuit diagram showing the circuit of a pixel in FIG. 2, according to one embodiment. First transistor M1 through fourth transistor M4, a storage capacitor Cst, a load capacitor Cload and an organic light emission element OLED are formed within each of the pixels P. The number of transistors and the connective relationships between the transistors in each pixel P can be modified in various ways.

The first, second and fourth transistors M1, M2 and M4 are switching transistors. The third transistor M3 is a drive transistor for generating drive current for lighting the organic light emission element OLED. The storage capacitor Cst maintains the data voltage DATA during a single frame. The load capacitor Cload temporarily maintains, for example, a voltage on the line 11.

The organic light emission element OLED is a member configured to emit light. The organic light emission element OLED can emit light having brightness or a gray level which varies in accordance with the drive current through the organic light emission element OLED. Such an organic light emission element OLED can include a red organic light emission element OLED configured to emit red light, a green organic light emission element OLED configured to emit green light, and a blue organic light emission element OLED configured to emit blue light.

The first transistor M1 through third transistor M3 can be implemented as NMOS-type thin film transistors. The first transistor M1 through third transistor M3 are turned-on by when the gate voltage of these transistors are at a high voltage level and are turned-off when the gate voltage of these transistors are a low voltage level. The low voltage level may be a ground voltage or a voltage level close to the ground voltage. The high voltage level is a voltage level higher than the low level signal by at least threshold voltage, but the top limit value of the high level signal can be varied by a designer.

The first power supply voltage VDD can be used as a high voltage level signal. The second power supply voltage VSS can be used as a low voltage level signal. However, the first and second power supply voltages VDD and VSS are not limited to these. The first and second power supply voltages VDD and VSS can be both DC (Direct Current) voltages having fixed levels.

A reference voltage REF can have a low voltage level. In other words, the reference voltage REF can be the ground voltage or a voltage close to the ground voltage. For example, the reference voltage REF can be the same as the second power supply voltage VSS or have a voltage higher than the second power supply voltage VSS.

The first transistor M1 can be electrically connected to a first node n1. More specifically, a gate electrode of the first transistor M1 is connected to the first scan line to receive the first scan signal SCAN1, a first terminal of the first transistor M1 is connected to the first data line 11, and a second terminal of the first transistor M1 is connected to the first node n1. When turned-on by the first scan signal SCAN1, the first transistor M1 can be turned on to pull up the voltage level of the first node n1 to the voltage level of the first data line 11. The data voltage on the first data line 11 may be generated to compensate the voltage level based on a sensing signal detected at the data driver 50.

The second transistor M2 is electrically connected to a second node n2. In detail, a gate electrode of the second transistor M2 is connected to the second scan signal line to receive the second scan signal SCAN2. A first terminal of the second transistor M2 is connected to receive reference voltage from a reference voltage line. A second terminal of the second transistor M2 is connected to the second node n2. When the second transistor M2 is turned-on by a second scan signal SCAN2, the voltage level of the second node n2 is adjusted by the reference voltage REF. For example, if the voltage level at the second node n2 is higher than the reference voltage REF, the voltage at the second node n2 can be pulled down. Meanwhile, when the voltage at the second node n2 is lower than the reference voltage REF, the second node n2 can be pulled up to the reference voltage REF.

A gate electrode of the third transistor M3 is connected to the first node n1. A first terminal of the third transistor M3 is connected to the first power supply line VDD. A second terminal of the third transistor M3 is connected to the second node n2. The third transistor M3 can generate a drive current based on the voltage different between the voltage at the first node n1 and the voltage on its second terminal (i.e., the voltage at the second node n2). The driver current flows through the organic light emission element OLED.

The storage capacitor Cst can be electrically connected between the first and second nodes n1 and n2. In detail, the storage capacitor Cst can have a first plate connected to the first node n1, and a second plate connected to the second node n2. The storage capacitor Cst maintains a voltage different between the voltage of the first node n1 and the voltage of the second node n2. For example, the voltage of the first node n1 can be the data voltage of the data voltage signal DATA and the voltage of the second node n2 can be the reference voltage REF.

The organic light emission element OLED can be electrically connected to the second node n2. More specifically, the organic light emission element OLED can have a first terminal connected to the second node n2, and a second terminal connected to a second power supply line VSS. The organic light emission element OLED operated based on the drive current Ioled generated by the third transistor M3 and emits light of brightness or a gray level corresponding to the drive current Ioled.

A gate electrode of the fourth transistor M4 can be connected to the third scan signal line to receive the third scan signal SCAN3. A first terminal of the fourth transistor M4 can be connected to the second node n2. A second terminal of the fourth transistor M4 can be connected to the second data line 12. When the fourth transistor M4 is turned on by the third scan signal SCAN3, the voltage of the second node n2 corresponding to a sensing signal representative of the threshold voltage of the third transistor or the threshold voltage of the organic light emission element OLED is transmitted to the second data line 12.

The pixel P may operate in two distinct periods: a light emission period and a sensing period. The pixel P can operate in the sensing period before powering on the organic light emitting display device, after powering off the organic light emitting display device, or during a vertical blank period between frames. As an example of the sensing period of the organic light emitting display device, the sensing operation can be performed for a first row of pixels in a first vertical blank period after a first frame. Also, the sensing operation can be performed for a second row of pixels in a second vertical blank period after a second frame. Moreover, the sensing operation can be performed for a third row of pixels in a third vertical blank interval after a third frame. In this manner, the sensing operation can be performed for the rest of the pixel rows.

Figure 4A:
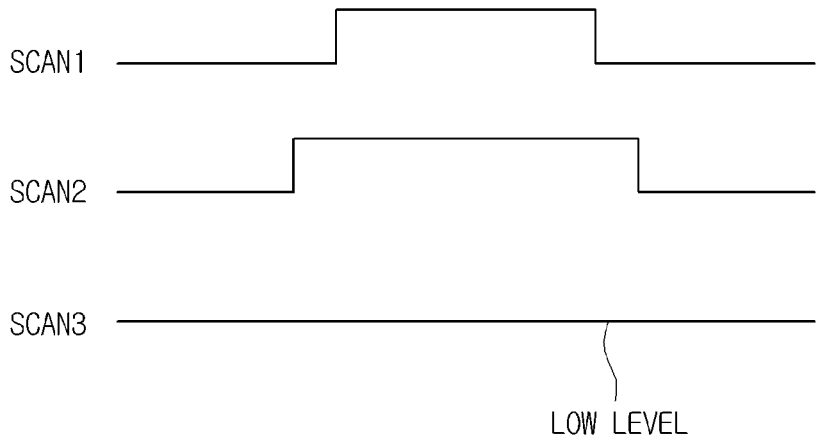
FIG. 4A is a waveform diagram illustrating scan signals applied to a pixel in a light emission period, according to one embodiment.

FIG. 4A is a waveform diagram illustrating scan signals applied to a pixel in a light emission period, according to one embodiment. In the light emission period, the first and second scan signals SCAN1 and SCAN2 can be at a high voltage level and the third scan signal SCAN3 can be at a low voltage level. In the example of FIG. 4A, the first and second scan signals SCAN1 and SCAN2 may be placed at a high voltage level for different duration (i.e., width). The second scan signal SCAN2 can have a width wider than that of the first scan signal SCAN1. In detail, the second scan signal SCAN2 can rise earlier before the first scan signal SCAN1 rises, and the second scan signal SCAN2 can drop after the first scan signal SCAN1 drops. In other embodiments, the first and second scan signals SCAN1 and SCAN2 may have the same width.

Figure 4B:
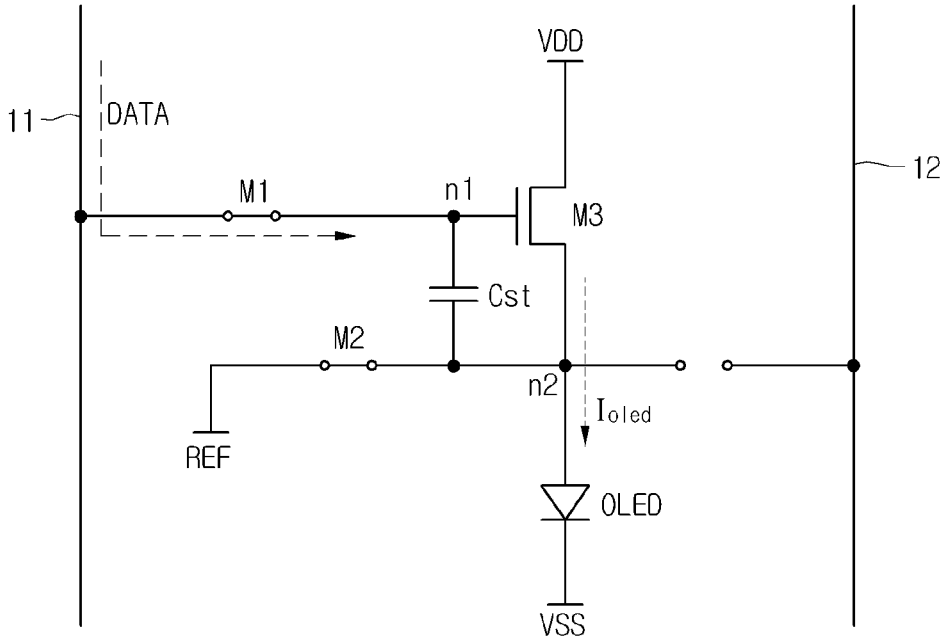
FIG. 4B is a circuit diagram showing the switched states of transistors within a pixel in a light emission period, according to one embodiment.

FIG. 4B is a circuit diagram showing the switched states of transistors within a pixel in a light emission period, according to one embodiment. The second transistor M2 is turned on by the second scan signal SCAN2 at a high voltage level (i.e., active state), and then the second node n2 is pulled up or down by the reference voltage REF. As such, the second node n2 is set to the reference voltage REF, which is used as a base reference voltage. Assume that the second node n2 is not set to the reference voltage REF (i.e., the second node n2 is adjusted to the reference voltage REF), the voltage at the second node n2 can vary depending on the variation of the first power supply voltage VDD and the varying properties of the organic light emission element OLED. In this case, when the data voltage DATA is applied to the first node n1, the drive current generated by the third transistor M3 varies depending on the voltage variation of the second node n2. As such, picture quality can deteriorate.

The first scan signal SCAN1 with a high level, which is behind the rising time of the second scan signal SCAN2, turns on the first transistor M1. As such, the data voltage DATA applied to the first data line 11 can be transmitted to the first node n1 through the first transistor M1.

While both the first and second scan signals SCAN1 and SCAN2 are placed at a high voltage level (e.g., during the first period of the light emission period), the voltage of the first node n1 is adjusted according to the data voltage DATA and the voltage of the second node n2 is adjusted according to the reference voltage REF. Subsequently, when both the first and second scan signals SCAN1 and SCAN2 drops to a low level (i.e., inactive state) after the high level period (i.e., during a second period of the light emission period), the third transistor M3 can generate the drive current corresponding to the difference between the data voltage of the first node n1 and the reference voltage REF of the second node n2. The drive current flows through the organic light emission element OLED, which causes the organic light emission element OLED to emit light.

Figure 5A:
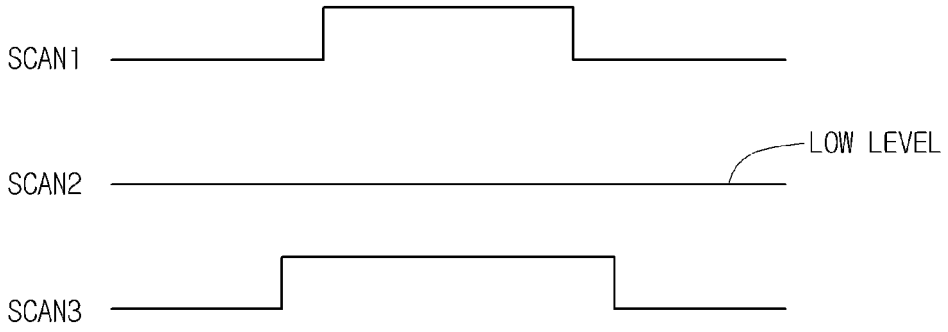
FIG. 5A is a waveform diagram illustrating scan signals applied to a pixel in a sensing period for detecting the property of a transistor in the pixel, according to one embodiment.

FIG. 5A is a waveform diagram illustrating scan signals applied to a pixel in a sensing period for detecting the property of a transistor in the pixel, according to one embodiment. The sensing period for detecting the property of the third transistor M3 may be placed within a vertical blank period between frames. The property of the third transistor M3 detected during the sensing period may include, among others, the threshold voltage of the third transistor M3.

During the sensing period, the first and third scan signals SCAN1 and SCAN3 are at a high voltage level, but the second scan signal SCAN2 is at a low voltage level. The first and third scan signals SCAN1 and SCAN3 may have different widths from each other. For example, the third scan signal SCAN3 can have a width wider than that of the first scan signal SCAN1. In this case, the third scan signal SCAN3 can rise before the first scan signal SCAN1 and drop after the first scan signal SCAN 1 drops to a low voltage level. Alternatively, the first scan signal SCAN 1 and the third scan signal SCAN3 can have the same width.

Figure 5B:
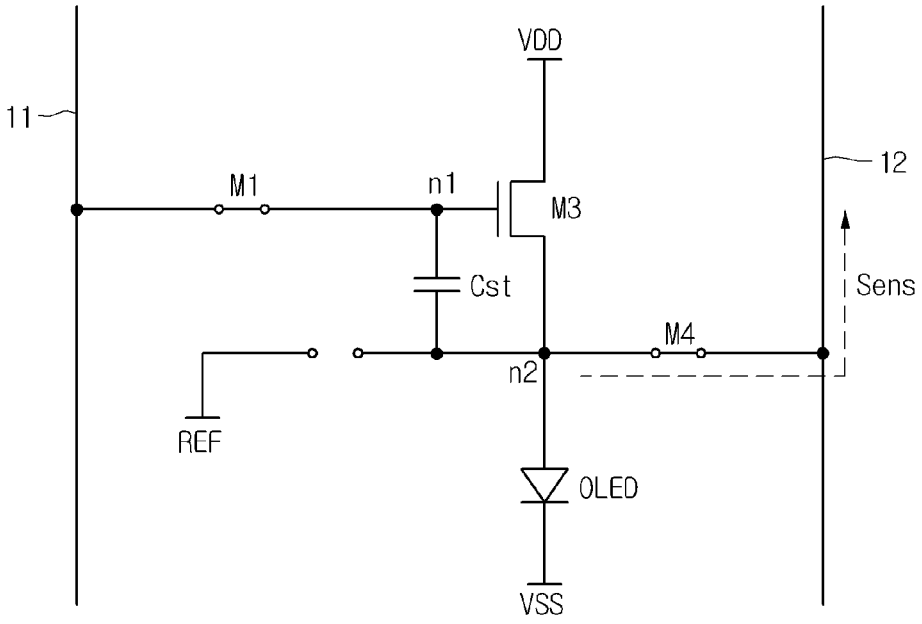
FIG. 5B is a circuit diagram showing the switched states of transistors within a pixel in a sensing period, according to one embodiment.

FIG. 5B is a circuit diagram showing the switching states of transistors within a pixel in a sensing period. During the sensing period, the third scan signal SCAN3 at a high voltage level can turn-on the fourth transistor M4. As a result, the second data line 12 connected to the data driver 50 is adjusted to the voltage level at the second node n2. The voltage of the second node n2 can be, for example, the threshold voltage of the third transistor M3.

During the light emission period of FIGS. 4A and 4B, the organic light emission element OLED can emit light until the voltage on the second terminal of the third transistor M3, (i.e., the voltage of the second node n2) coincides with the threshold voltage of the third transistor M3.

Ordinarily, the organic light emission element OLED can emit light for a single frame by the storage capacitor Cst. As such, the sensing signal detected from the second node n2 by the sensing operation of FIGS. 5A and 5B, which is performed during the vertical blank period after a single frame, can become the threshold voltage of the third transistor M3. The threshold voltage of the third transistor M3 varies for different the pixels P. As such, the sensing signal detected for each of the pixels may be different.

The data driver 50 transmits the sensing signals detected from the pixels P to the controller 30. Based on the sensing signals (representing the threshold voltages of the third transistors M3), the controller 30 can generated compensated versions of data signals. The compensated data signals R'G'B' are then converted into compensated data voltage signals DATA by the data driver 50. The compensated data voltage signals DATA are applied to the pixels P, so that the organic light emission elements OLED emit light. For example, the higher the sensing signal, the larger an offset signal or a gain signal in the compensated data signal becomes. On the contrary, the lower the sensing signal, the smaller the offset signal or the gain signal reflected in the compensated data signal becomes.

The drive current Ioled in the organic light emission element OLED can be represented by the following equation 1.

$$\text{Ioled}=k*(\text{DATA}-V\text{th})^2 \quad (1)$$

wherein, "DATA" refers to a data voltage to a pixel, "Vth" refers to a threshold voltage of the third transistor M3 in the pixel, and "k" refers to a constant value.

To maintain the drive current at the same value, the data voltage must increase by the increment of the threshold voltage Vth or decrease by the decrement of the threshold voltage Vth. For example, if a normal threshold voltage is 2V and the data voltage DATA is 4V, the drive current Ioled can be calculated to be "4 k" by "$\text{Ioled}=k*(4-2)^2=4\ k$". When the threshold voltage of the third transistor M3 within the pixel P rises to 3.5V that is higher than the normal threshold voltage by 1.5V, the offset value of 1.5V can be added to the data voltage DATA. As such, a compensated data voltage with 5.5V can be applied to the pixel P. In this case, the drive current can be obtained from "$\text{Ioled}=k*(5.5-3.5)^2=4\ k$".

The first scan signal SCAN1 at the high voltage level can turn on the first transistor M1. The turned on first transistor M1 can transmit another reference voltage, which is applied from the data driver 50 to the first data line 11, to the first node n1. Another reference voltage can be different from the data voltage being used to emit light. On the other hand, the other reference voltage can be the same as the reference voltage REF which is applied to the second node n2 by the turned on second transistor M2.

The voltage of the first node n1 is constantly maintained by another reference voltage. As such, the voltage of the second node n2 is not affected by the first node n1. Therefore, the voltage of the second node n2, for example, the threshold voltage of the third transistor M3, can be originally transmitted to the data driver 50 through the fourth transistor M4 and the second data line 12, without any variation.

Figure 6A:
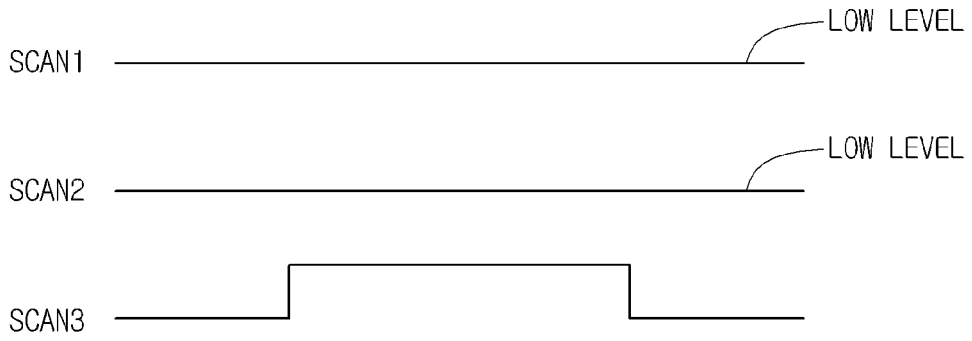
FIG. 6A is a waveform diagram illustrating scan signals applied to a pixel in a sensing period for detecting the property of an organic light emission element in the pixel, according to one embodiment.

FIG. 6A is a waveform diagram illustrating scan signals applied to a pixel P in a sensing period for detecting the property of an organic light emission element in the pixel P, according to one embodiment. The sensing period for detecting the property of the organic light emission element OLED may be placed within a vertical blank period between frames. The property of the organic light emission element OLED detected may include, among others, the threshold voltage of the organic light emission element OLED. The threshold voltage of the organic light emission element OLED in each pixel P may be different. In the sensing period for detecting the property of the organic light emission element OLED, the third scan signal SCAN3 is at a high voltage level but the first and second scan signals SCAN1 and SCAN2 are maintained at the low voltage level.

Figure 6B:
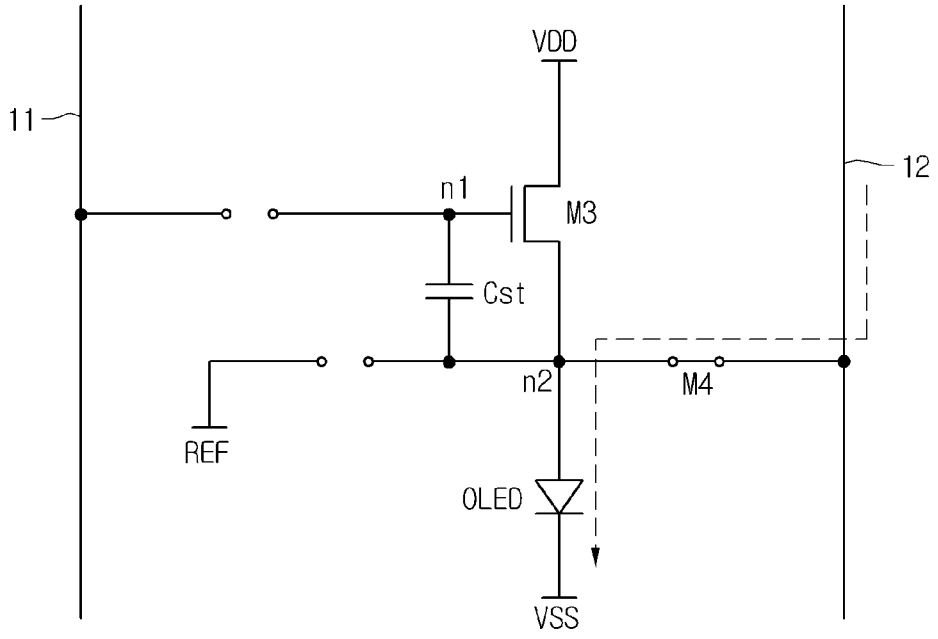
FIG. 6B is a circuit diagram showing the switched states of transistors within a pixel in a sensing period, according to one embodiment.

FIG. 6B is a circuit diagram showing the switching states of transistors within a pixel P in a sensing period, according to one embodiment. The first and second transistors M1 and M2 are turned-off by the first and second scan signals SCAN1 and SCAN2 each at a low voltage level. As a result, the data voltage and the reference voltage REF are not applied to the first and second nodes n1 and n2. Accordingly, the third transistor M3 does not generate drive current to operate the organic light emission element OLED.

The third scan signal SCAN3 at a high voltage level can turn-on the fourth transistor M4. Then, a constant current generated from the data driver 50 to the second data line 12 can flow through the organic light emission element OLED through the fourth transistor M4. In other words, a current path from the data driver 50 to the organic light emission element OLED through the data line 12 and the fourth transistor M4 is formed. By measuring the current in the path, the data driver 50 can sense the property of the organic light emission element OLED. The sensed current can be converted into a sensing signal representing the threshold voltage of the organic light emitting element OLED.

The sensing signal is sent from the data driver 50 to the controller 30. Based on the sensing signal, the controller 30 can supply the data driver 50 with a compensated version of the data signal. The data driver 50 can convert the compensated data signal into a compensated data voltage which will be applied to the pixel P. Therefore, the threshold voltage of the organic light emission element OLED with each pixel P can be compensated.

In the above description, the first power supply voltage VDD is described as being always applied to the third transistor M3. However, it is preferable that the first power supply voltage VDD is not applied to the third transistor M3 while at least one of the first through third scan signals SCAN1 through SCAN3 stays at a high voltage level. For this purpose, a fifth transistor (not shown) may be disposed on the first power supply and used to control the supply of the first power supply voltage VDD. The fifth transistor can be a NMOS thin film transistor that can be turned-on by a fourth scan signal at a high voltage level. For example, the fourth scan signal can be at a low voltage level when at least one of the first through third scan signals SCAN1 through SCAN3 is at a high voltage level. On the contrary, if all of the first through third scan signals SCAN1 through SCAN3 are at a low voltage level, the fourth scan signal can be at a high voltage level.

Figure 7:
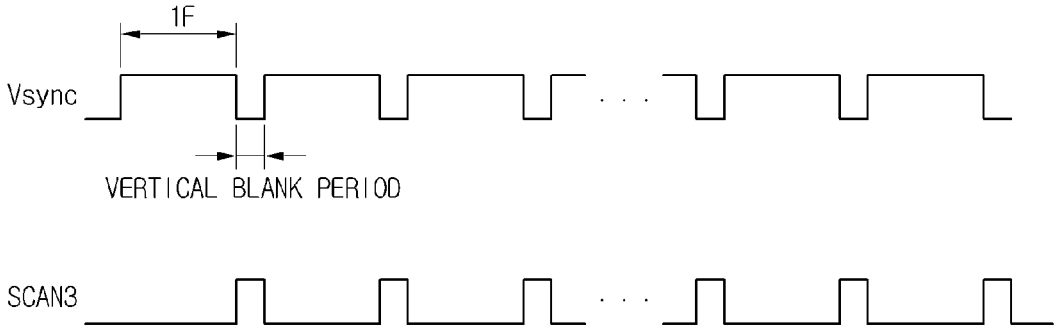
FIG. 7 is a waveform diagram showing a scan signal used in sensing relative to a vertical synchronous signal, according to one embodiment.

FIG. 7 is a waveform diagram showing the scan signal SCAN3 used in sensing relative to a vertical synchronous signal Vsync, according to one embodiment. The vertical synchronous signal Vsync remains at a high voltage level during a single frame and then drops to a low voltage level during a vertical blank period. The vertical blank period is repeated at a constant interval. In one embodiment, the scan signal SCAN3 may turn active during the vertical blank period.

Figure 8:
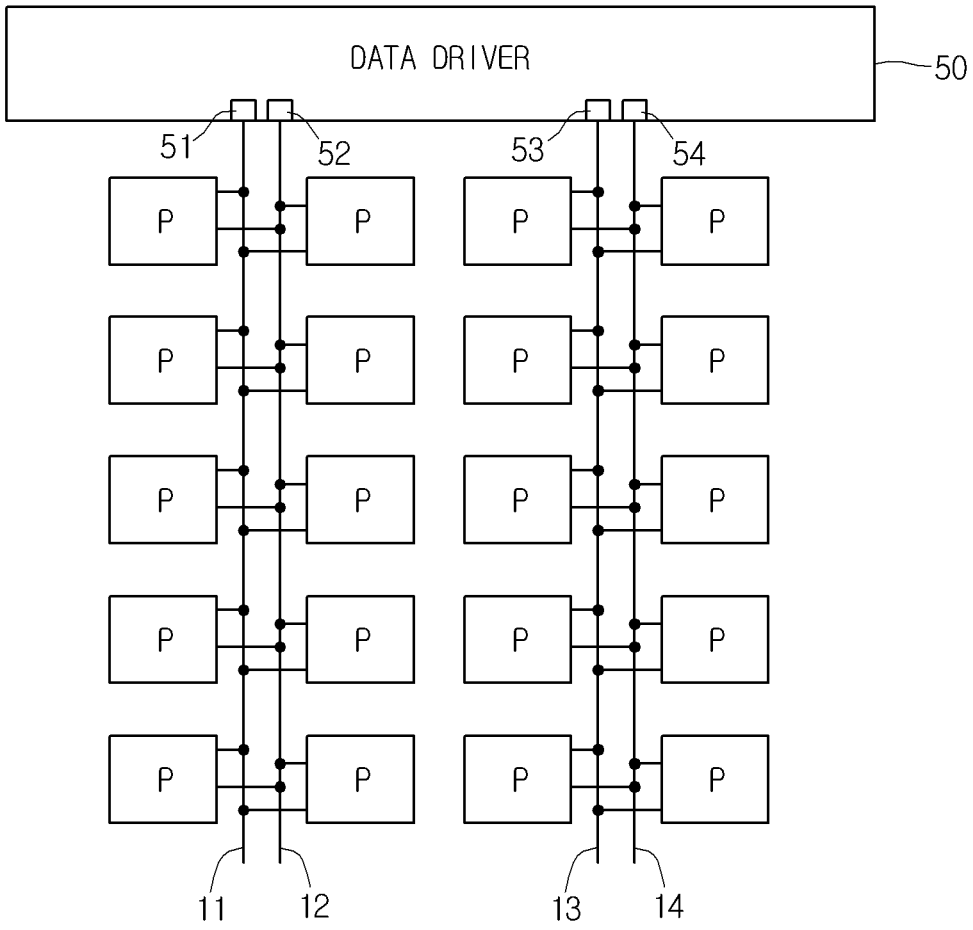
FIG. 8 is a plan view showing an organic light emitting panel according to another embodiment.

FIG. 8 is a plane view showing an organic light emitting panel according to another embodiment. The organic light emitting panel of FIG. 8 has the same configuration as that of the first embodiment described above, except that data lines 11 through 14 are arranged adjacently to each other in pairs. As such, the same reference numbers used for describing the organic light emitting panel of FIG. 2 is used for describing the organic light emitting panel of FIG. 8.

Referring to FIG. 8, the organic light emitting panel 10 may include a plurality of data lines 11 through 14 connected to the data driver 50. The data lines 11 through 14 can be connected to the channels 51 through 54 of the data driver 50. The data lines 11 through 14 can be placed adjacent to each other in pairs. In detail, each pair of data lines 11 and 12 or 13 and 14 pan be disposed between two pixel columns. Hereafter, the pixels arranged on the left side of each pair of data lines 11 and 12 or 13 and 14 are called as odd-numbered pixels, and the pixels arranged on the right side of each pair of data lines 11 and 12 or 13 and 14 are called as even-numbered pixels. Similarly, data lines 11 and 13 adjacent to the odd-numbered pixels P are called as odd-numbered data lines, and data lines 12 and 14 adjacent to the even-numbered pixels P are called as even-numbered data lines.

The first and second pixels P are connected to the first and second data lines 11 and 12. The first pixel P can receive the data voltage from the first data line 11, and the sensing signal detected from the first pixel P can be apply to the second data line 12. Meanwhile, the second pixel P can receive the data voltage from the second data line 12, and the sensing signal detected from the second pixel P can be apply to the second data line 11.

In this manner, each pair of data lines 11 and 12 or 13 and 14 can be shared with the pixel columns adjacent thereto. As a result, the number of data lines 11 through 14 matches the number of pixel columns. For example, the data lines 11 through 14 and the pixel columns can both be four, as shown in FIG. 8.

Therefore, the organic light emitting panel of FIG. 8 has a reduced number of data lines compared to the organic light emitting panel of FIG. 2. Accordingly, the number of channels of the data driver 50 can also be more reduced.

As described above, the same signal line can be used to receive an analog data voltage signal DATA and also a sensing signal Sens to determine the threshold voltage of a drive transistor and/or the properties of the organic light emission element in a pixel. The controller may adjust the analog data voltage signal DATA based on the sensing signal Sens to compensate variations in the threshold voltage of a drive transistor and/or the properties of the organic light emission element in a pixel. By using the same signal lines for the analog data voltage signal DATA and the sensing signal Sens, the number of channels in the data driver can be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light-emitting display device, comprising:

a data driver configured to generate data signals;

a plurality of columns of pixels arranged in pairs, each of the pairs of columns of pixels comprising first and second columns of pixels; and a plurality of signal lines disposed between the pairs of columns of pixels and arranged adjacent to each other in pairs, the pairs of signal lines comprising first and second signal lines and each of the pairs of signal lines is connected to the pair columns of pixels, each pixel in the first column of pixels comprising:

a first transistor between the first signal line of the plurality of signal lines and a first node, the first transistor configured to selectively connect the first node to the first signal line to receive a data signal for the pixel during first times;

a second transistor connected to a second node and configured to control a supply of a reference voltage during the first times;

an organic light emission element connected to the second node and a first supply voltage line;

a driving transistor between a second supply voltage line and the second node, the driving transistor configured to generate driving currents through the organic light emission element during the first times, wherein the driving transistor is configured to operate according to a voltage at the first node;

a storage capacitor connected between the first and second nodes to maintain the data voltage; and a third transistor between the second node and a second signal line of the plurality of signal lines, the third transistor configured to selectively connect the second signal line to transmit sensing signals representing a threshold voltage of the driving transistor from the second node during second times, the second signal line transmitting data signals for pixels in the second column of pixels during the first times, wherein the second times comprise vertical blank periods.

2. The organic light-emitting display device of claim 1, wherein the first column of pixels is arranged on one side of the pair of signal lines.

3. The organic light-emitting display device of claim 1, wherein the second column of pixels is arranged on another side of the pair of signal lines.

4. The organic light-emitting display device of claim 1, wherein the first and second transistors are turned on during the first times to connect the first signal line to the first node and connect the reference voltage to the second node.

5. The organic light-emitting display device of claim 1, wherein the third transistor is turned on during the second times to sense the sensing signals.

6. An apparatus comprising:

an array of pixels arranged in pixel column pairs, each pixel column pair having a first pixel column and a second pixel column; and a pair of signal lines between the first pixel column and the second pixel column, one of pair of signal lines having a first signal line connected to entire pixels in the first pixel column and to entire pixels in the second pixel column, and the other of pair of signal lines having a second signal line connected to the entire pixels in the first pixel column and to the entire pixels in the second pixel column;

a data driver connected to the pair signal lines to transmits data signal to the pair signal lines and receive sensing signals from the pair signal lines, each pixel in the first column of pixels comprising:

a first transistor between the first signal line of the plurality of signal lines and a first node, the first transistor configured to selectively connect the first node to the first signal line to receive a data signal for the pixel during first times;

a second transistor connected to a second node and configured to control a supply of a reference voltage for a light emission period;

an organic light emission element connected to the second node and a first supply voltage line;

a driving transistor between a second supply voltage line and the second node, the driving transistor configured to generate driving currents through the organic light emission element for a light emission period, wherein the driving transistor is configured to operate according to a voltage at the first node;

a storage capacitor connected between the first and second nodes to maintain the data voltage; and a third transistor between the second node and a second signal line of the plurality of signal lines, the third transistor configured to selectively connect the second signal line to transmit sensing signals representing a threshold voltage of the driving transistor from the second node for a sensing period, the second signal line transmitting data signals for pixels in the second column of pixels for a light emission period, wherein the second times comprise vertical blank periods.

7. The apparatus of claim 6, wherein the sensing period relates to the array of pixels operating before powering on the organic light emission elements, after powering off the organic light emission elements, or during a vertical blank period between frames.

8. The apparatus of claim 6, wherein the first and the second signal lines configured to be connected to the data driver and configured to carry both data signals and sensing signals result in a minimal number of required signal lines and a minimal number of required connection terminals in the data driver.

* * * * *